US007852142B2

(12) United States Patent
Ogiwara et al.

(10) Patent No.: US 7,852,142 B2
(45) Date of Patent: Dec. 14, 2010

(54) REFERENCE VOLTAGE GENERATING CIRCUIT FOR USE OF INTEGRATED CIRCUIT

(75) Inventors: Ryu Ogiwara, Kanagawa-ken (JP); Daisaburo Takashima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 88 days.

(21) Appl. No.: 12/250,121

(22) Filed: Oct. 13, 2008

(65) Prior Publication Data

US 2009/0096510 A1 Apr. 16, 2009

(30) Foreign Application Priority Data

Oct. 15, 2007 (JP) ..... 2007-268227

(51) Int. Cl.
*G05F 1/10* (2006.01)

(52) U.S. Cl. ..... 327/538; 327/540; 327/541; 327/543

(58) Field of Classification Search ..... None
See application file for complete search history.

(56) References Cited

U.S. PATENT DOCUMENTS 4,134,026 A * 1/1979 Sone et al. ..... 307/137
4,598,215 A * 7/1986 Schechtman et al. ..... 327/66
4,658,157 A * 4/1987 McGowan ..... 327/66
5,898,323 A * 4/1999 Suda ..... 327/66
6,160,391 A * 12/2000 Banba
6,310,797 B1 10/2001 Muneno
6,420,909 B1 * 7/2002 Barnes ..... 327/63
6,452,437 B1 * 9/2002 Takeuchi
6,549,065 B2 * 4/2003 Opris
6,995,605 B2 * 2/2006 Hazucha et al. ..... 327/551
7,119,528 B1 * 10/2006 Rasmus
7,372,243 B2 * 5/2008 Kimura
2003/0006747 A1 * 1/2003 Jaussi
2005/0237105 A1 * 10/2005 Park
2006/0087347 A1 * 4/2006 Sumi ..... 327/72
2007/0085601 A1 * 4/2007 Idei et al. ..... 327/558
2007/0200616 A1 * 8/2007 Shin
2008/0094050 A1 * 4/2008 Sugai
2008/0116965 A1 * 5/2008 Ogiwara
2009/0096509 A1 * 4/2009 Lai
2009/0174468 A1 * 7/2009 Yoshida

FOREIGN PATENT DOCUMENTS

JP 2003-173212 6/2003
JP 2004-192608 7/2004

* cited by examiner

*Primary Examiner*—Tuan Lam
(74) *Attorney, Agent, or Firm*—Oblon, Spivak, McClelland, Maier & Neustadt, L.L.P.

(57) ABSTRACT

An amplifying circuit receives an output from a comparator. The output is provided to each gate of first, second and third transistors. First and second resistors are connected in series. The first and second resistors and a first diode are connected to a drain of the first transistor. Second diodes are connected in parallel. The second diodes are connected to one end of a third resistor. The other end of the third resistor is connected to a drain of the second transistor. Fourth and fifth resistors are connected in series. One end of the fourth resistor is connected to the drain of the second transistor. The comparator receives first and second feedback voltages respectively obtained from a connection node between the first and second resistors and a connection node between the fourth and fifth resistors. A drain of the third transistor outputs a reference voltage.

7 Claims, 6 Drawing Sheets

REFERENCE VOLTAGE GENERATING CIRCUIT FOR USE OF INTEGRATED CIRCUIT

CROSS REFERENCE TO RELATED APPLICATION

This application is based upon and claims the benefit of priority from the prior Japanese Patent Application No. 2007-268227, filed on Oct. 15, 2007, the entire contents of which are incorporated herein by reference.

FIELD OF THE INVENTION

The present invention relates to a reference voltage generating circuit for use of an integrated circuit such as a semiconductor memory device or a SoC (System on Chip).

DESCRIPTION OF THE BACKGROUND

With the development in miniaturization and high-integration of semiconductor elements, strong requirement arises for reduction in voltage of a power source which is used for an integrated circuit such as a semiconductor memory device or a SoC. Accordingly, various reference voltage generating circuits have been developed which operate at a low power supply voltage and which generate a voltage serving as a reference voltage for use of an interior of an integrated circuit.

Japanese Patent Application Publication (Kokai) No. 11-45125 discloses a bandgap reference circuit serving as a reference voltage generating circuit. The bandgap reference circuit includes a bandgap reference section and a comparator. The bandgap reference section can operate at a power supply voltage being as low as about one Volt. However, the comparator does not operate at a power supply voltage of 1.5 Volt or less, for example.

Consequently, the bandgap reference circuit as a whole does not operate at a low power supply voltage of 1.5 Volt or less, for example. When the threshold voltage of a transistor constituting the comparator is lowered to operate the comparator at a low voltage, leak current is increased, which increases power consumption.

SUMMARY OF THE INVENTION

1. An aspect of the present invention provides a reference voltage generating circuit including a first P-channel insulated-gate field-effect transistor having a gate, a source connected to a higher voltage power supply, and a drain, a second P-channel insulated-gate field-effect transistor having a gate, a source connected to the higher voltage power supply, and a drain, a third P-channel insulated-gate field-effect transistor having a gate, a source connected to the higher voltage power supply, and a drain for outputting a reference voltage, a first diode having a cathode connected to a lower voltage power supply and an anode connected to the drain of the first P-channel insulated-gate field-effect transistor, first and second resistors connected in series to each other and connected between the drain of the first P-channel insulated-gate field-effect transistor and the lower voltage power supply and a third resistor having one end connected to the drain of the second P-channel insulated-gate field-effect transistor, fourth and fifth resistors connected in series to each other and connected between the drain of the second P-channel insulated-gate field-effect transistor and the lower voltage power supply, a plurality of second diodes connected in parallel with one another, each of the second diodes having an anode connected to the other end of the third resistor and a cathode connected to the lower voltage power supply, a first comparator receiving a first feedback voltage obtained from a connection node between the first and second resistors and receiving a second feedback voltage obtained from a connection node between the fourth and fifth resistors, and a first amplifying circuit amplifying an output signal outputted from the first comparator and outputting the amplified signal to the gates of the first, the second and the third P-channel insulated-gate field-effect transistors.

Another aspect of the present invention provides a reference voltage generating circuit including a first P-channel insulated-gate field-effect transistor having a gate, a source connected to a higher voltage power supply and a drain, a second P-channel insulated-gate field-effect transistor having a gate, a source connected to the higher voltage power supply and a drain, a third P-channel insulated-gate field-effect transistor having a gate, a source connected to the higher voltage power supply and a drain for outputting a reference voltage, a first diode-connected N-channel insulated-gate field-effect transistor having one end connected to a lower voltage power supply and the other end connected to the drain of the first P-channel insulated-gate field-effect transistor, first and second resistors connected in series to each other and connected between the drain of the first P-channel insulated-gate field-effect transistor and the lower voltage power supply, a third resistor having one end connected to the drain of the second P-channel insulated-gate field-effect transistor, fourth and fifth resistors connected in series to each other and connected between the drain of the second P-channel insulated-gate field-effect transistor and the lower voltage power supply, a plurality of second diode-connected N-channel insulated-gate field-effect transistors connected in parallel with one another, each of the second diode-connected N-channel insulated-gate field-effect transistors having one end connected to the other end of the third resistor and the other end connected to the lower voltage power supply, a first comparator receiving a first feedback voltage obtained from a connection node between the first and second resistors and a second feedback voltage obtained from a connection node between the fourth and fifth resistors, and a first amplifying circuit amplifying an output signal outputted from the first comparator, the first amplifying circuit outputting the amplified signal to the gates of the first, the second and the third P-channel insulated-gate field-effect transistor.

DETAILED DESCRIPTION OF THE INVENTION

The embodiments of the present invention will be described below with reference to drawings.

Figure 1:
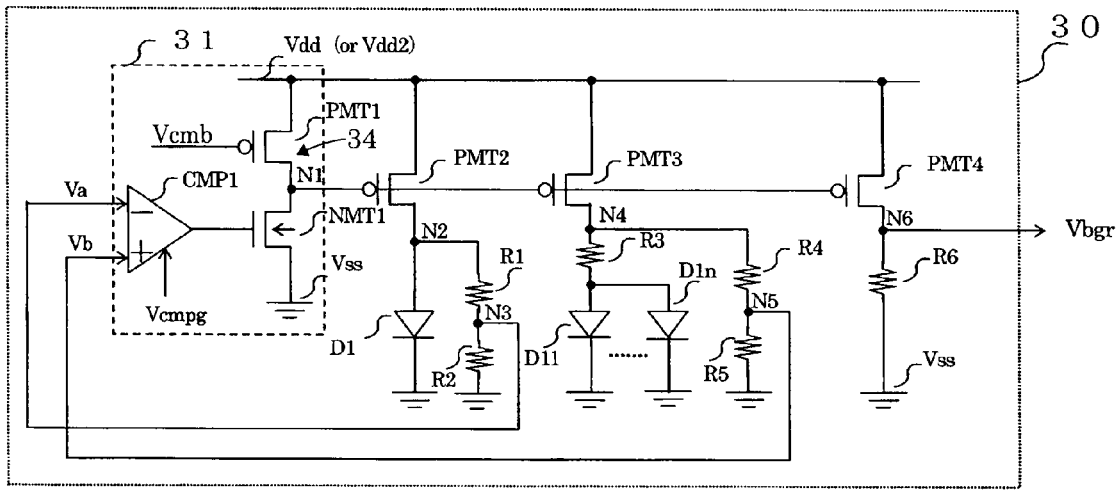
FIG. 1 is a circuit diagram showing a bandgap reference circuit serving as a reference voltage generating circuit according to a first embodiment of the present invention.
Figure 2:
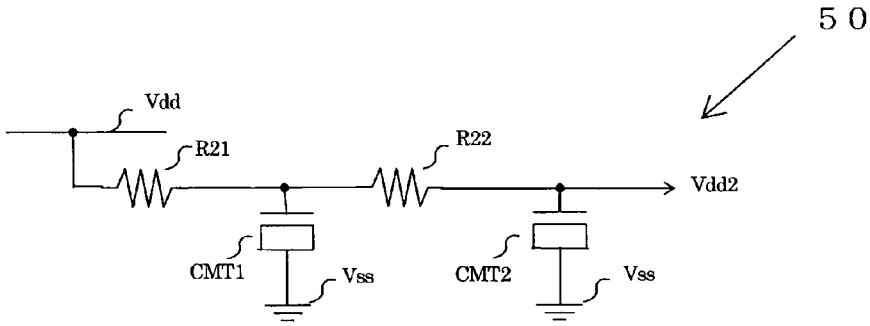
FIG. 2 is a circuit diagram showing a higher voltage power generating unit for use of the first embodiment.
Figure 3:
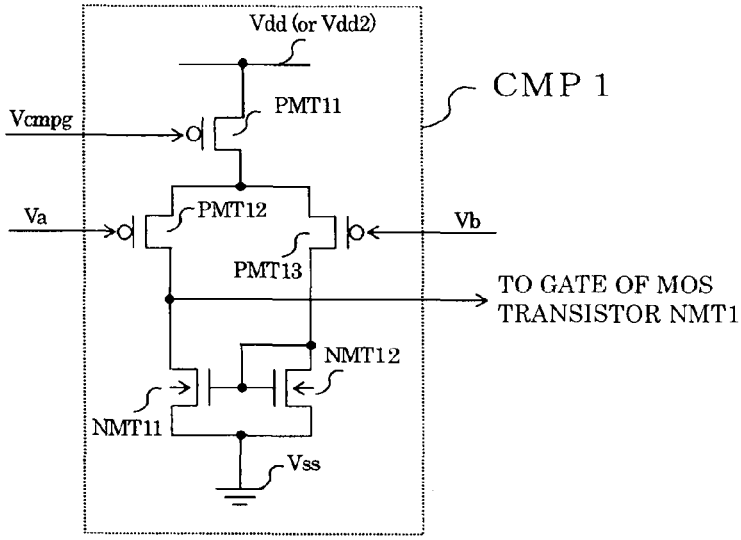
FIG. 3 is a circuit diagram showing a comparator for use of the first embodiment.
Figure 4:
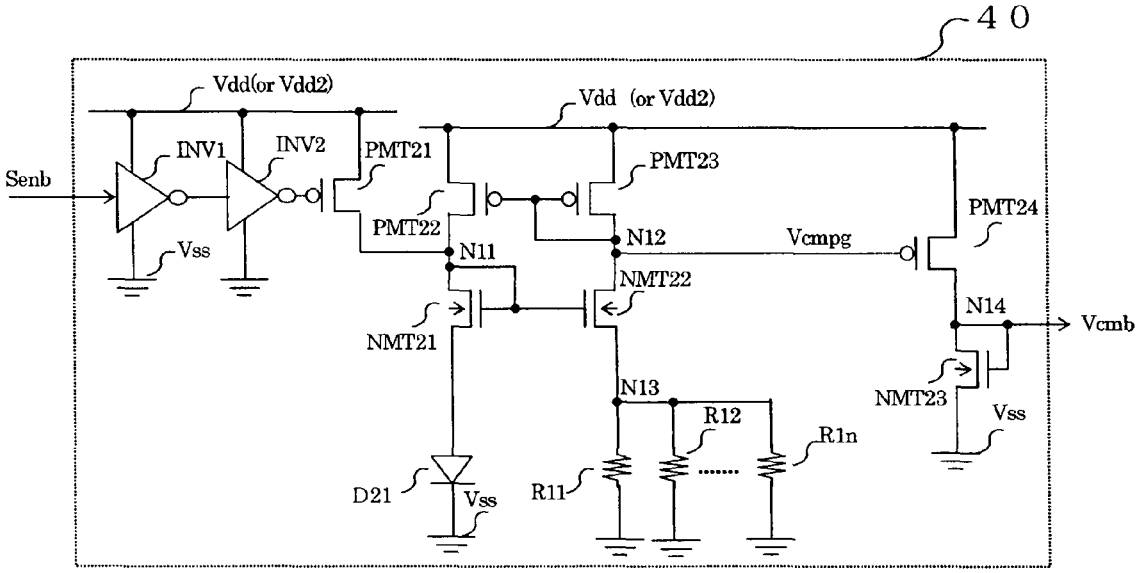
FIG. 4 is a circuit diagram showing a bias generating circuit for use of the first embodiment.

A bandgap reference circuit serving as a reference voltage generating circuit, according to a first embodiment of the present invention, will be described with reference to FIGS. 1 to 4. FIG. 1 is a circuit diagram showing the bandgap reference circuit serving as the reference voltage generating circuit according to the first embodiment. FIG. 2 is a circuit diagram showing a higher voltage power generating unit. FIG. 3 is a circuit diagram showing a comparator. FIG. 4 is a circuit diagram showing a bias generating circuit.

As shown in FIG. 1, a bandgap reference circuit 30 is provided with an amplifier 31, P-channel MOS transistors PMT2 to PMT4 as insulated-gate field-effect transistors, diodes D11 to D1*n*, and resistors R1 to R6. The diodes D1 and D11 to D1*n* are connected in parallel with one another.

The bandgap reference circuit 30 is used as a reference voltage generating circuit for generating an internal power source voltage of a semiconductor memory device, for example. The MOS transistors PMT2 to PMT4 are a normally-off type (also referred to as an enhancement type or E type) MOS transistor.

The amplifier 31 is provided with a comparator CMP1, a P-channel MOS transistor PMT1, and an N-channel MOS transistor NMT1. The source of the P-channel MOS transistor PMT1 is connected to either a higher voltage power supply Vdd serving as an external power supply or a higher voltage power supply Vdd2 generated in a higher voltage power generating unit. A control voltage Vcmb is inputted to the gate of the P-channel MOS transistor PMT1. The drain of the P-channel MOS transistor PMT1 is connected to a node N1. The drain of the N-channel MOS transistor NMT1 is connected to the node N1. The source of the N-channel MOS transistor NMT1 is connected to a lower voltage power supply (grounding potential) Vss.

The output signal from the comparator CMP1 is inputted to the gate of the N-channel MOS transistor NMT1. The amplified signal of the output signal from the comparator CMP1 is outputted from the drain (node N1) of the N-channel MOS transistor NMT1. The P-channel MOS transistor PMT1 and the N-channel MOS transistor NMT1 each function as a first amplifying circuit 34.

The voltage of the higher voltage power supply Vdd2 is generated by a higher voltage power generating unit 50 shown in FIG. 2. The higher voltage power generating unit 50 is provided with MOS transistor capacitors CMT1 and CMT2, and resistors R21 and R22. The higher voltage power generating unit 50 generates the stable voltage of the higher voltage power supply Vdd2 even if the voltage of the higher voltage power supply Vdd serving as an external power supply varies.

In FIG. 2, one end of the resistor R21 is connected to the higher voltage power supply Vdd. One end (on a gate side) of the MOS transistor capacitor CMT1 is connected to the other end of the resistor R21. The other end of the MOS transistor capacitor CMT1 is connected to the lower voltage power supply (grounding potential) Vss. One end of the resistor R22 is connected to the other end of the resistor R21 and to the one end of the MOS transistor capacitor CMT1. One end (on a gate side) of the MOS transistor capacitor CMT2 is connected to the other end of the resistor R22. The other end of the MOS transistor capacitor CMT2 is connected to the lower voltage power supply (grounding potential) Vss. The voltage of the higher voltage power supply Vdd2 is outputted from the other end of the resistor R22 and the one end of the MOS transistor capacitor CMT2.

The comparator CMP1 of FIG. 1 is provided with P-channel MOS transistors PMT11 to PMT13, and N-channel MOS transistors NMT11 and NMT 12 as shown in FIG. 3. The source of the P-channel MOS transistor PMT11 is connected to the higher voltage power supply Vdd or the higher voltage power supply Vdd2. A control voltage Vcmpg is inputted to the gate of the P-channel MOS transistor PMT11. The P-channel MOS transistor PMT11 functions as a current source of the comparator CMP1.

The source of the P-channel MOS transistor PMT12 is connected to the drain of the P-channel MOS transistor PMT11. A feedback voltage Va shown in FIG. 1 is inputted to the gate of the P-channel MOS transistor PMT12. The gate of the P-channel MOS transistor PMT12 corresponds to the input side minus (−) port of the comparator CMP1. The source of the P-channel MOS transistor PMT13 is connected to the drain of the P-channel MOS transistor PMT11. A feedback voltage Vb shown in FIG. 1 is inputted to the gate of the P-channel MOS transistor PMT13. The gate of the P-channel MOS transistor PMT13 corresponds to the input side plus (+) port of the comparator CMP1. The P-channel MOS transistors PMT12 and PMT13 form a differential pair.

The drain of the N-channel MOS transistor NMT11 is connected to the drain of the P-channel MOS transistor PMT12. The source of the N-channel MOS transistor NMT11 is connected to the lower voltage power supply (grounding potential) Vss. The drain of the N-channel MOS transistor NMT12 is connected to the drain of the P-channel MOS transistor PMT13. The gate and drain of the N-channel MOS transistor NMT12 are connected to each other. The gate of the N-channel MOS transistor NMT12 is connected to the gate of the N-channel MOS transistor NMT11. The source of the N-channel MOS transistor NMT12 is connected to the lower voltage power supply (grounding potential) Vss.

The N-channel MOS transistors NMT11 and NMT12 form a current mirror circuit. The signal from the drain of the N-channel MOS transistor NMT11 is outputted to the gate of the N-channel MOS transistor NMT1 shown in FIG. 1 as an output signal from the comparator CMP1.

In FIG. 1, the source of the P-channel MOS transistor PMT2 is connected to the higher voltage power supply Vdd or the higher voltage power supply Vdd2. The gate of the P-channel MOS transistor PMT2 is connected to node N1. The drain of the P-channel MOS transistor PMT2 is connected to a node N2. The source of the P-channel MOS transistor PMT3 is connected to the higher voltage power supply Vdd or the higher voltage power supply Vdd2. The gate of the P-channel MOS transistor PMT3 is connected to the node N1. The drain of the P-channel MOS transistor PMT3 is connected to a node N4. The source of the P-channel MOS transistor PMT4 is connected to the higher voltage power supply Vdd or the higher voltage power supply Vdd2. The gate of the P-channel MOS transistor PMT4 is connected to the node N1. The drain of the P-channel MOS transistor PMT4 is connected to a node N6. A reference voltage Vbgr is outputted from the drain (node N6) of the P-channel MOS transistor PMT4.

The reference voltage Vbgr outputted from the bandgap reference circuit 30 shown in FIG. 1 is 1.25 V, for example, and is little voltage-dependent and little temperature-dependent.

In FIG. 1, the anode of the diode D1 is connected to the node N2. The cathode of the diode D1 is connected to the lower voltage power supply (grounding potential) Vss. One end of the resistor R1 is connected to the node N2. The other end of the resistor R1 is connected to a node N3. One end of the resistor R2 is connected to the node N3. The other end of the resistor R2 is connected to the lower voltage power supply (grounding potential) Vss. A voltage resistively divided by the resistors R1 and R2 cascade-connected to each other is outputted from the node N3 to the comparator CMP1 as the feedback voltage Va.

One end of the resistor R3 is connected to the node N4. The anode and cathode of the first diode D11 of the diodes arranged in parallel with one another are connected to the other end of the resistor R3 and to the lower voltage power supply (grounding potential) Vss, respectively. The anodes of the diodes D11 to D1*n* arranged in parallel with one another are connected to the other end of the resistor R3. The cathodes of the diodes D11 to D1*n* are connected to the lower voltage power supply (grounding potential) Vss.

One end of the resistor R4 is connected to the node N4. The other end of the resistor R4 is connected to a node N5. One end of the resistor R5 is connected to the node N5. The other end of the resistor R5 is connected to the lower voltage power supply (grounding potential) Vss. A voltage resistively divided by the resistors R4 and R5 cascade-connected to each other is outputted from the node N5 to the comparator CMP1 as the feedback voltage Vb. One end of the resistor R6 is connected to the node N6. The other end of the resistor R6 is connected to the lower voltage power supply (grounding potential) Vss.

The resistances of the resistors R1, R2, R4 and R5 are set as follows, for example.

$$R1:R2=3:1 \quad (1)$$

$$R4:R5=3:1 \quad (2)$$

The relationship between a voltage Vn2 of the node N2 and a voltage Vn3 of the node N3 and the relationship between a voltage Vn4 of the node N4 and a voltage Vn5 of the node N5 are set as follows.

$$Vn3=Va=(1/4)\times Vn2 \quad (3)$$

$$Vn5=Vb=(1/4)\times Vn4 \quad (4)$$

The feedback voltages Va, Vb are set so that the voltage between the source and the gate of each of the P-channel MOS transistors PMT 12, PMT13, which form the differential pair of the comparator CMP1 of FIG. 3, can be not less than the threshold voltages (Vth) of the P-channel MOS transistors PMT12 and PMT13.

It is necessary to set the absolute values of the threshold voltages of the P-channel MOS transistor and the N-channel MOS transistor constituting the comparator CMP1 at or above a certain level, about 0.7 V, for example, in order to operate the comparator CMP1 with a voltage in a range of 1.5 V or less, for example, with low power consumption. Assuming that the voltage Vn2 of the node N2 and the voltage Vn4 of the node N4 are directly used as feedback voltages to operate the comparator CMP1, stable feedback voltages are about 0.8 V, for example. Consequently, it is difficult to operate the comparator CMP1 in a range of 1.5 V or less, for example.

In the present embodiment, as described above, the feedback voltages are reduced by resistive division. For example, when the voltage Vn2 of the node N2 and the voltage Vn4 of the node N4 are each 0.2 V, the voltage Vn3 (Va) of the node N3 and the voltage Vn5 (Vb) of the node N5 are each 0.05 V, for example. Consequently, the feedback voltages inputted to the comparator CMP1, which operate the comparator CMP1 stably, can be reduced. The voltage of the higher voltage power supply Vdd or the higher voltage power supply Vdd2 of 1.5 V or less, for example, allows the comparator CMP1 to be operated.

In FIG. 4, a bias generating circuit 40 is provided with a diode D21, inverters INV1 and INV2, N-channel MOS transistors NMT21 to NMT23, P-channel MOS transistors PMT21 to PMT24, and resistors R11 to R1*n*.

A control signal Senb is inputted to the bias generating circuit 40 in FIG. 4 to generate the control voltages Vcmpg and Vcmb that control the bandgap reference circuit 30 in FIG. 1. The control voltage Vcmpg is used to reduce the bias current of the comparator CMP1 provided in the bandgap reference circuit 30. The control voltage Vcmb is used to control the P-channel MOS transistor PMT1 of FIG. 1 to control the amplifier 31.

In FIG. 4, the inverter INV1 is provided between the higher voltage power supply Vdd or the higher voltage power supply Vdd2 and the lower voltage power supply (grounding potential) Vss. The control signal Senb is inputted to the inverter INV1. The inverter INV1 outputs an inverted signal. The inverter INV2 is provided between the higher voltage power supply Vdd or the higher voltage power supply Vdd2 and the lower voltage power supply (grounding potential) Vss.

The signal outputted from the inverter INV1 is inputted to the inverter INV2. The inverter INV2 outputs an inverted signal. The signal outputted from the inverter INV2 is inputted to the gate of the P-channel MOS transistor PMT21. The source of the P-channel MOS transistor PMT21 is connected to the higher voltage power supply Vdd or the higher voltage power supply Vdd2. The drain of the P-channel MOS transistor PMT21 is connected to a node N11.

The drain of the P-channel MOS transistor PMT 22 is connected to the node N11 in common with the drain of the P-channel MOS transistor PMT21. The source of the P-channel MOS transistor PMT 22 is connected to the higher voltage power supply Vdd or the higher voltage power supply Vdd2. The gate of the P-channel MOS transistor PMT22 is connected to the gate of the P-channel MOS transistor PMT 23. The source of the P-channel MOS transistor PMT23 is connected to the higher voltage power supply Vdd or the higher voltage power supply Vdd2. The gate of the P-channel MOS transistor PMT23 is connected to the drain of the P-channel MOS transistor PMT23 and a node N12. The control voltage Vcmpg is outputted from the node N12 (drain).

The drain (node N12) of the P-channel MOS transistor PMT23 is connected to the gate of the P-channel MOS transistor PMT24. The source of the P-channel MOS transistor PMT24 is connected to the higher voltage power supply Vdd or the higher voltage power supply Vdd2. The drain of the P-channel MOS transistor PMT24 is connected to a node N14. The control voltage Vcmb is outputted from the node N14 (drain).

The drain of the N-channel MOS transistor NMT21 is connected to the node N11. The gate of the N-channel MOS transistor NMT 21 is connected to the drain of the N-channel MOS transistor NMT21. The drain of the N-channel MOS transistor NMT22 is connected to the node N12. The gate of the N-channel MOS transistor NMT22 is connected to the gate of the N-channel MOS transistor NMT21. The source of the N-channel MOS transistor NMT22 is connected to a node N13.

The source of the N-channel MOS transistor NMT21 is connected to the anode of the diode D21. The cathode of the diode D21 is connected to the lower voltage power supply (grounding potential) Vss. An "n" number of resistors R11, R12 . . . , R1*n* connected in parallel with one another are connected between the node N13 and the lower voltage power supply (grounding potential) Vss. The "n" is a positive integer. The drain of the N-channel MOS transistor NMT23 is connected to the node N14. The gate of the N-channel MOS transistor NMT23 is connected to the drain of the N-channel MOS transistor NMT23. The source of the N-channel MOS transistor NMT23 is connected to the lower voltage power supply (grounding potential) Vss.

The P-channel MOS transistors PMT22 and PMT23 form a current mirror circuit. The N-channel MOS transistors NMT21 and NMT 22 form a current mirror circuit. The P-channel MOS transistors PMT22 and PMT23 and the N-channel MOS transistors NMT21 and NMT22 form a Wilson constant current circuit.

The output current from the Wilson constant current circuit is less influenced by the variations of the properties of the MOS transistor than the output current from the current mirror circuit, and is thus stable. Specifically, when a first current flows through a first series circuit formed of the P-channel MOS transistor PMT22, the N-channel MOS transistor NMT21 and the diode D21, the current is mirrored to the side of a second series circuit formed of the P-channel MOS transistor PMT23 and the N-channel MOS transistor NMT22. Thus, a second current flows through the second series circuit stably.

The stable control voltage Vcmb is supplied to the gate of the P-channel MOS transistor PMT1 constituting the amplifier 31. Consequently, a stable voltage can be outputted from the amplifier 31 to stabilize the reference voltage Vbgr. The bias generating circuit 40 can operates even if the higher voltage power supply Vdd or the higher voltage power supply Vdd2 provides a low voltage.

As described above, in the reference voltage generating circuit shown in FIG. 1, the gates of the P-channel MOS transistors PMT2 to PMT4 are controlled by the output from the node N1 of the amplifier 31. The cascade-connected resistors R1 and R2 are connected between the drain of the P-channel MOS transistor PMT2 and the lower voltage power supply (grounding potential) Vss.

The resistors R1 and R2 are connected to the diode D1 in parallel. The voltage resistively divided by the resistors R1 and R2 is outputted as the feedback voltage Va from the node N3 to the comparator CMP1 constituting the amplifier 31. The cascade-connected resistors R4 and R5 are connected between the drain of the P-channel MOS transistor PMT3 and the lower voltage power supply (grounding potential) Vss.

The resistors R4 and R5 are connected in parallel with a circuit formed of the resistor R3 and the diodes D11 to D1*n*. The voltage resistively divided by the resistors R4 and R5 is outputted as the feedback voltage Vb from the node N5 to the comparator CMP1. This allows the voltages Va and Vb feedback-inputted to the comparator CMP1 to be reduced. The reference voltage Vbgr outputted from the node N6 of the drain of the P-channel MOS transistor PMT4 is little supply-voltage-dependent and little temperature-dependent. The voltages Va and Vb is substantially constant voltage even if the voltage of the higher voltage power supplies is low.

Furthermore, in the reference voltage generating circuit shown in FIG. 1, the bias current of the comparator CMP1 can be reduced by using the stable control voltage Vcmpg outputted from the bias generating circuit 40 in FIG. 4. The bandgap reference circuit 30 can be operated with low power consumption. The bias generating circuit 40 can be operated when the voltage of the higher voltage power supply Vdd or the higher voltage power supply Vdd2 is low.

In the present embodiment, a MOS transistor is used as a transistor constituting the bandgap reference circuit 30 and the bias generating circuit 40. However, an MIS transistor (Metal-Insulator-Semiconductor Field Effect Transistor) may also be used instead of the MOS transistor.

Figure 5:
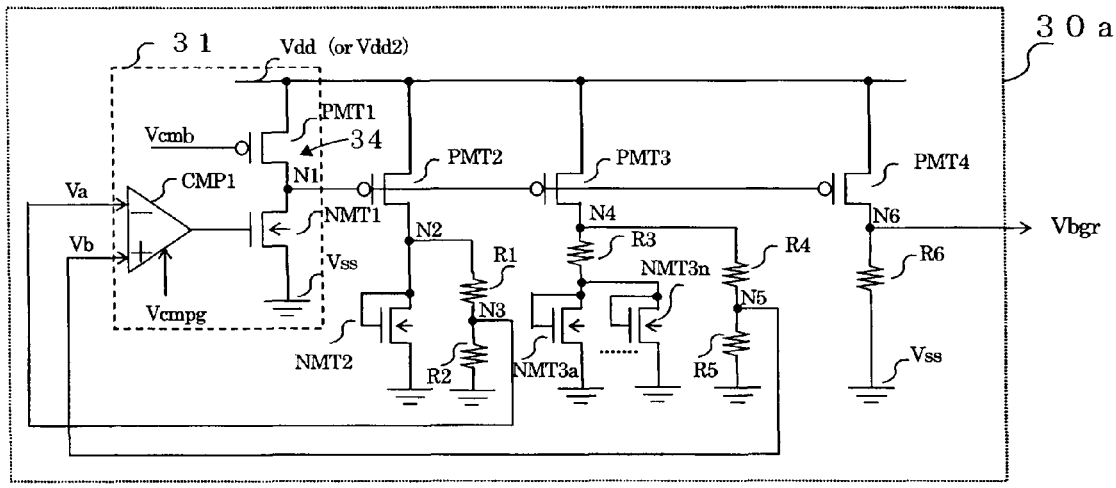
FIG. 5 is a circuit diagram showing a bandgap reference circuit serving as a reference voltage generating circuit according to a second embodiment of the present invention.
Figure 6:
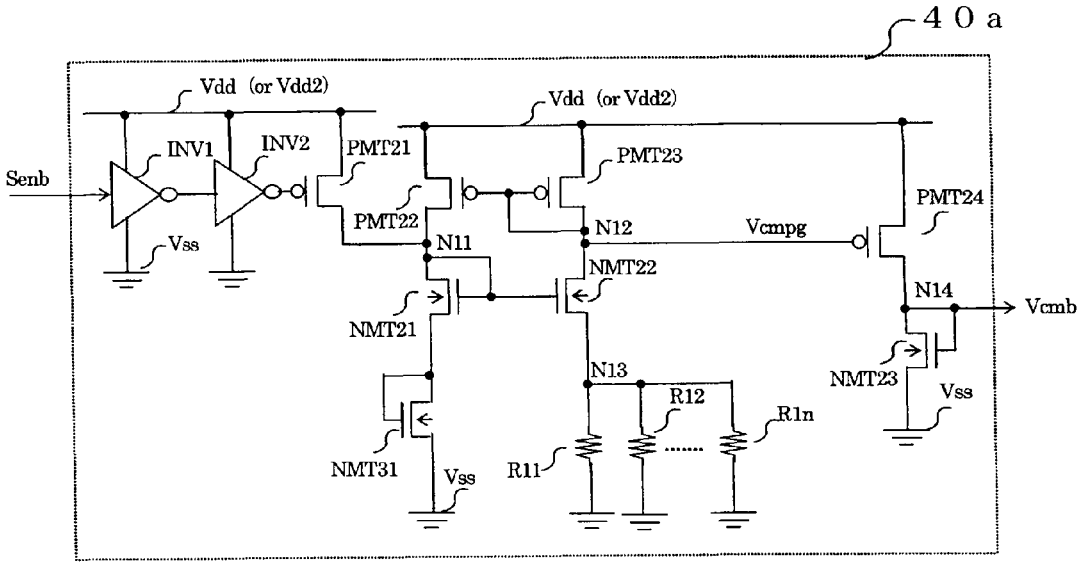
FIG. 6 is a circuit diagram showing a bias generating circuit for use of the second embodiment.

A reference voltage generating circuit according to a second embodiment of the present invention will be described below with reference to drawings. FIG. 5 is a circuit diagram showing a bandgap reference circuit serving as the reference voltage generating circuit according to the second embodiment of the present invention. FIG. 6 is a circuit diagram showing a bias generating circuit for use of the second embodiment.

In FIGS. 5 and 6, the same parts as those in FIGS. 1 and 4 are given the same reference numerals.

As shown in FIG. 5, a bandgap reference circuit 30*a* is provided with an amplifier 31, P-channel MOS transistors PMT2 to PMT4, an N-channel MOS transistor NMT2, N-channel MOS transistors NMT3*a* to NMT3*n*, and resistors R1 to R6. The bandgap reference circuit 30*a* is used as a reference voltage generating circuit for generating the internal power source of a semiconductor memory device, for example. In the bandgap reference circuit 30*a*, the diodes used in the bandgap reference circuit 30 of FIG. 1 are replaced with the diode-connected N-channel MOS transistors NMT3*a* to NMT3*n*.

The drain of the N-channel MOS transistor NMT2 is connected to a node N2 and the gate of the N-channel MOS transistor NMT2. The source of the N-channel MOS transistor NMT2 is connected to a lower voltage power supply (grounding potential) Vss. The N-channel MOS transistors NMT3*a* to NMT3*n* are connected in parallel with one another. The N-channel MOS transistors NMT3*a* to NMT3*n* are connected between the resistor R3 and the lower voltage power supply (grounding potential) Vss. The gates of the N-channel MOS transistors NMT3*a* to NMT3*n* are respectively diode-connected to the drains of the N-channel MOS transistors NMT3*a* to NMT3*n*.

Threshold voltages Vth of the N-channel MOS transistors NMT2, NMT3*a* to NMT3*n* are respectively set lower than the forward voltages of the diodes D1, D11 to D1*n* of the first embodiment sown in FIG. 1.

Feedback voltages Va and Vb supplied to a comparator CMP1 can be generated by using the N-channel MOS transistors NMT2, NMT3*a* to NMT3*n*, each of which has a low threshold voltage and is diode-connected, even if the voltage of a higher voltage power supply Vdd or a higher voltage power supply Vdd2 is low.

Control voltages Vcmpg and Vcmb to be supplied to the bandgap reference circuit 30*a* of FIG. 5 are supplied from a bias generating circuit 40*a* shown in FIG. 6. As shown in FIG. 6, the bias generating circuit 40*a* is provided with inverters INV1 and INV2, N-channel MOS transistors NMT21 to NMT23, P-channel MOS transistors PMT21 to PMT24, resistors R11 to R1*n*, and an N-channel MOS transistor NMT31.

A control signal Senb is inputted to the bias generating circuit 40*a* to generate the control voltages Vcmpg and Vcmb that control the bandgap reference circuit 30*a*. The control voltage Vcmpg is used to reduce the bias current of the comparator CMP1 provided to the bandgap reference circuit 30*a*.

In addition, the control voltage Vcmb is used to control the amplifier 31. In the bias generating circuit 40*a* of FIG. 6, the diode D21 of the bias generating circuit 40 of FIG. 4 is replaced with the diode-connected N-channel MOS transistor NMT31.

The drain of the N-channel MOS transistor NMT31 is connected to the source of the N-channel MOS transistor NMT21. The gate of the N-channel MOS transistor NMT31 is connected to the drain of the N-channel MOS transistor NMT31. The source of the N-channel MOS transistor NMT31 is connected to the lower voltage power supply (grounding potential) Vss.

Here, the relationship among a threshold voltage Vtha of the N-channel MOS transistor NMT31, a threshold voltage Vthb of the N-channel MOS transistors NMT21 and NMT22, and a forward voltage Vf of the diode D21 is set as the following formula, for example.

$$Vtha<Vthb<Vf \quad (5)$$

The control voltage Vcmpg used to reduce the operation current of the comparator CMP1 can be generated by using the N-channel MOS transistor NMT31 having a low threshold voltage and diode-connected, even if the voltage of the higher voltage power supply Vdd or the higher voltage power supply Vdd2 is low. Moreover, the control voltage Vcmb of the comparator CMP1 can also be generated.

As described above, in the reference voltage generating circuit 30*a* of the present embodiment, the N-channel MOS transistor NMT2, the N-channel MOS transistors NMT3*a* to NMT3*n*, and the N-channel MOS transistor NMT31 are a diode-connected transistor respectively. The threshold voltage of these diode-connected transistors is set lower than the forward voltage Vf of pn-diodes.

As a consequence, in the embodiment, the bandgap reference circuit 30*a* can be operated at the voltage of the higher voltage power supply Vdd or the higher voltage power supply Vdd2 which is lower than that in the first embodiment.

Figure 7:
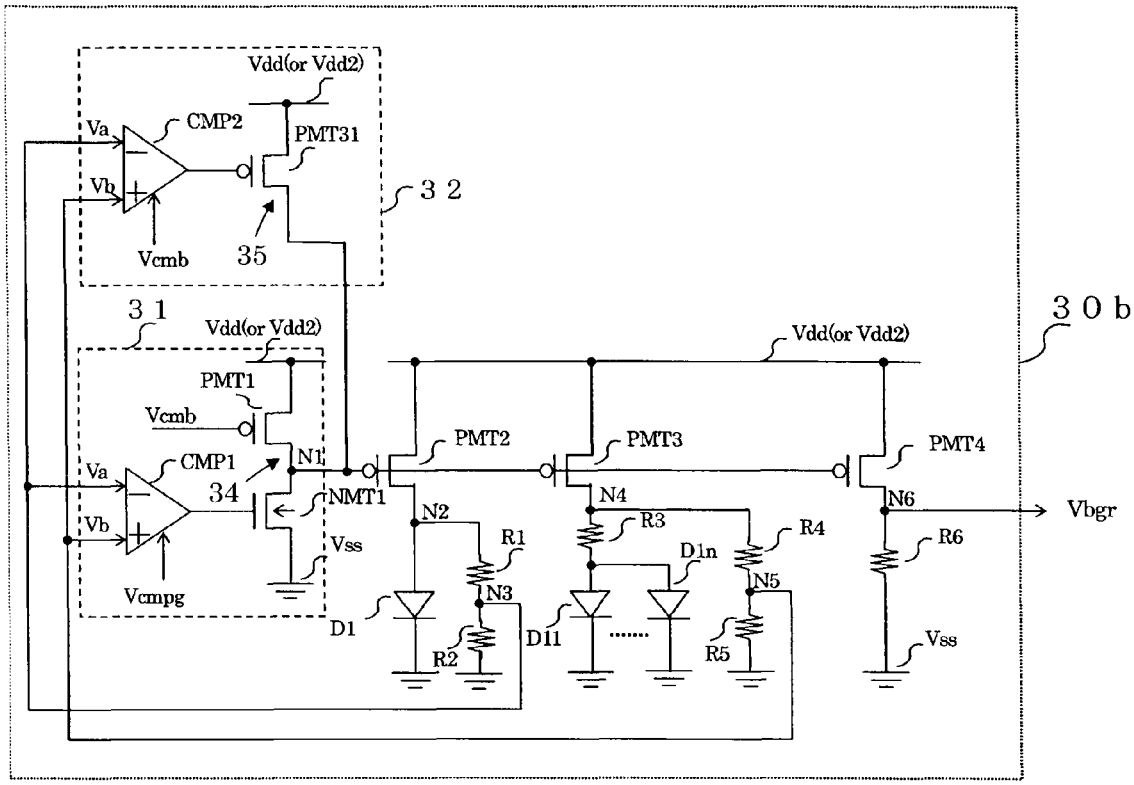
FIG. 7 is a circuit diagram showing a bandgap reference circuit serving as a reference voltage generating circuit according to a third embodiment of the present invention.
Figure 8:
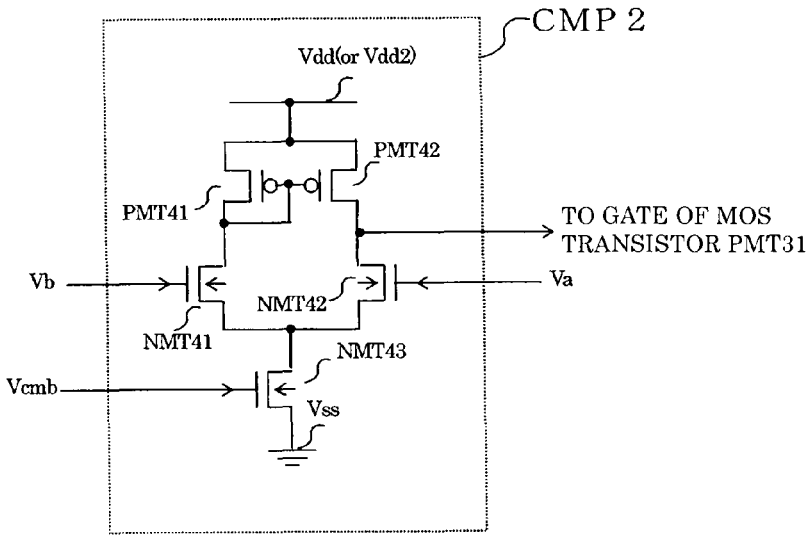
FIG. 8 is circuit diagram showing a comparator for use of the third embodiment.

A reference voltage generating circuit according to a third embodiment of the present invention will be described below with reference to drawings. FIG. 7 is a circuit diagram showing a bandgap reference circuit serving as the reference voltage generating circuit according to the third embodiment of the present invention. FIG. 8 is a circuit diagram showing a comparator for use of the third embodiment.

In FIGS. 7 and 8, the same parts as those in FIGS. 1 and 3 are given the same reference numerals.

In FIG. 7, a bandgap reference circuit 30*b* is provided with amplifiers 31 and 32, P-channel MOS transistors PMT2 to PMT4, a diode D1, diodes D11 to D1*n*, and resistors R1 to R6. The bandgap reference circuit 30*b* is used as a reference voltage generating circuit for generating the internal power source of a semiconductor memory device, for example. The MOS transistor used in the present embodiment is of normally-off type (also referred to as an enhancement type or an E-type).

The amplifiers 31 and 32 perform the so-called "Rail-to-Rail" operation. Specifically, the amplifier 31 operates in a voltage range where the voltage of a higher voltage power supply Vdd or a higher voltage power supply Vdd2 is not more than the predetermined value. The amplifier 32 operates in a voltage range where the voltage of the higher voltage power supply Vdd or the higher voltage power supply Vdd2 is higher than the predetermined value. Consequently, the bandgap reference circuit 30*b* can generate a reference voltage Vbgr which is little temperature-dependent and voltage-dependent over the high and low voltage ranges of the higher voltage power supply Vdd or the higher voltage power supply Vdd2.

The amplifier 32 is provided with a comparator CMP2 and a P-channel MOS transistor PMT31. The source of the P-channel MOS transistor PMT 31 is connected to the higher voltage power supply Vdd or the higher voltage power supply Vdd2. A signal outputted from the comparator CMP2 is inputted to the gate of the P-channel MOS transistor PMT31. The drain of the P-channel MOS transistor PMT31 is connected to a node N1. An amplified signal is outputted from the drain (node N1) of the P-channel MOS transistor PMT31.

The P-channel MOS transistor PMT1 and the N-channel MOS transistor NMT1 of the amplifier 31 function as a first amplifying circuit 34. The P-channel MOS transistor PMT31 of the amplifier 32 and the N-channel MOS transistor NMT1 constitute a second amplifying circuit 35.

The configuration of the comparator CMP1 is as described by FIG. 3. The comparator CMP2 is provided with P-channel MOS transistors PMT41 and PMT42, and N-channel MOS transistors NMT41 to NMT43 as shown in FIG. 8.

The source of the P-channel MOS transistor PMT41 is connected to the higher voltage power supply Vdd or the higher voltage power supply Vdd2. The gate of the P-channel MOS transistor PMT41 is connected to the drain of the P-channel MOS transistor PMT41. The source of the P-channel MOS transistor PMT42 is connected to the higher voltage power supply Vdd or the higher voltage power supply Vdd2. The gate of the P-channel MOS transistor PMT42 is connected to the gate of the P-channel MOS transistor PMT41. The P-channel MOS transistors PMT41 and PMT42 constitute a current mirror circuit.

The drain of the N-channel MOS transistor NMT41 is connected to the drain of the P-channel MOS transistor PMT41. A feedback voltage Vb is inputted to the gate of the N-channel MOS transistor NMT41. The gate of the N-channel MOS transistor NMT41 corresponds to the input side plus (+) port of the comparator CMP2. The drain of the N-channel MOS transistor NMT42 is connected to the drain of the P-channel MOS transistor PMT42. A feedback voltage Va is inputted to the gate of the N-channel MOS transistor NMT42. The gate of the N-channel MOS transistor NMT43 corresponds to the input side minus (−) port of the comparator CMP1. The N-channel MOS transistors NMT41 and NMT42 constitute a differential pair.

The drain of the N-channel MOS transistor NMT43 is connected to the sources of the N-channel MOS transistors NMT41 and NPT42. A control voltage Vcmb is inputted to the gate of the N-channel MOS transistor NMT43. The N-channel MOS transistor NMT43 functions as the current source of the comparator CMP2. The drains of the P-channel MOS transistor PMT42 and the N-channel MOS transistor NMT42 are connected to the gate of the P-channel MOS transistor PMT31 constituting the amplifier 32.

The feedback voltages Va and Vb are set so that the source-gate voltages of the N-channel MOS transistors NMT42 and NMT41 constituting a differential pair in the comparator CMP2 can be not less than the respective threshold voltages Vth of the N-channel MOS transistors NMT42 and NMT41. It is desirable to use the bias generating circuit 40*a* of the second embodiment shown in FIG. 6 for a bias generating circuit for generating control voltages Vcmpg and Vcmb.

As described above, in the reference voltage generating circuit of the present embodiment, the amplifier 31 operates in a voltage range where the voltage of a higher voltage power supply Vdd or a higher voltage power supply Vdd2 is low. Meanwhile, the amplifier 32 operates in a voltage range where the voltage of a higher voltage power supply Vdd or a higher voltage power supply Vdd2 is higher than the predetermined level. In other words, the amplifiers 31 and 32 perform Rail-to-Rail operation.

Consequently, the reference voltage Vbgr which is little temperature-dependent and voltage-dependent can be generated over the low and high voltage ranges of the higher voltage power supply Vdd or the higher voltage power supply Vdd2.

Figure 9:
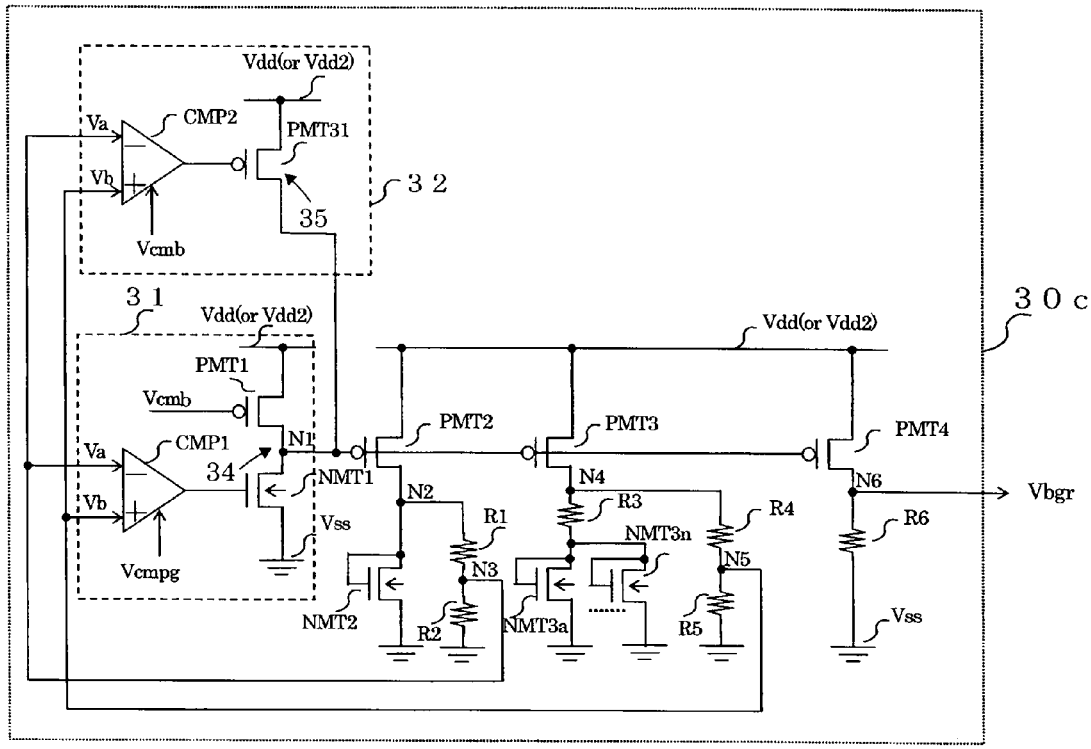
FIG. 9 is a circuit diagram showing a bandgap reference circuit serving as a reference voltage generating circuit according to a fourth embodiment of the present invention.

A reference voltage generating circuit according to a fourth embodiment of the present invention will be described with reference to drawings. FIG. 9 is a circuit diagram showing a bandgap reference circuit serving as the reference voltage generating circuit according to the fourth embodiment of the present invention.

In FIG. 9, the same parts as those in FIG. 7 are given the same reference numerals.

As shown in FIG. 9, a bandgap reference circuit 30*c* is provided with amplifiers 31 and 32, P-channel MOS transistors PMT2 to PMT4, N-channel MOS transistor NMT2, N-channel MOS transistors NMT3*a* to NMT3*n*, and resistors R1 to R6. The bandgap reference circuit 30*c* is used as a reference voltage generating circuit for generating the internal power source of a semiconductor memory device, for example. The MOS transistor used in the present embodiment is of normally-off type (also referred to as an enhancement type or an E-type).

The drain of the N-channel MOS transistor NMT2 is connected to a node N2 and the gate of the N-channel MOS transistor NMT2. The source of the N-channel MOS transistor NMT2 is connected to a lower voltage power supply (grounding potential) Vss. The N-channel MOS transistors NMT3*a* to NMT3*n* connected in parallel with one another are connected between the resistor R3 and the lower voltage power supply (grounding potential) Vss.

Threshold voltages Vth of the N-channel MOS transistor NMT2, and the N-channel MOS transistors NMT3*a* to NMT3*n* are set lower than the forward voltages of the diode D1, and diodes D11 to D1*n* in FIG. 7.

In a bandgap reference circuit 30*c*, the amplifier 31 operates in a voltage range where the voltage of the higher voltage power supply Vdd or the higher voltage power supply Vdd2 is low. The amplifier 32 operates in a voltage range where the voltage of the higher voltage power supply Vdd or the higher voltage power supply Vdd2 is higher than a predetermined level. Accordingly, the reference voltage generating circuit of the present embodiment performs a Rail-to-Rail operation.

Furthermore, the threshold voltages of the N-channel MOS transistor NMT2, and the N-channel MOS transistors NMT3*a* to NMT3*n* are set at a low level. Thus, a reference voltage Vbgr can be generated over the lower and higher voltage ranges of the higher voltage power supply Vdd or the higher voltage power supply Vdd2 than those of the third embodiment of FIG. 7.

Figure 10:
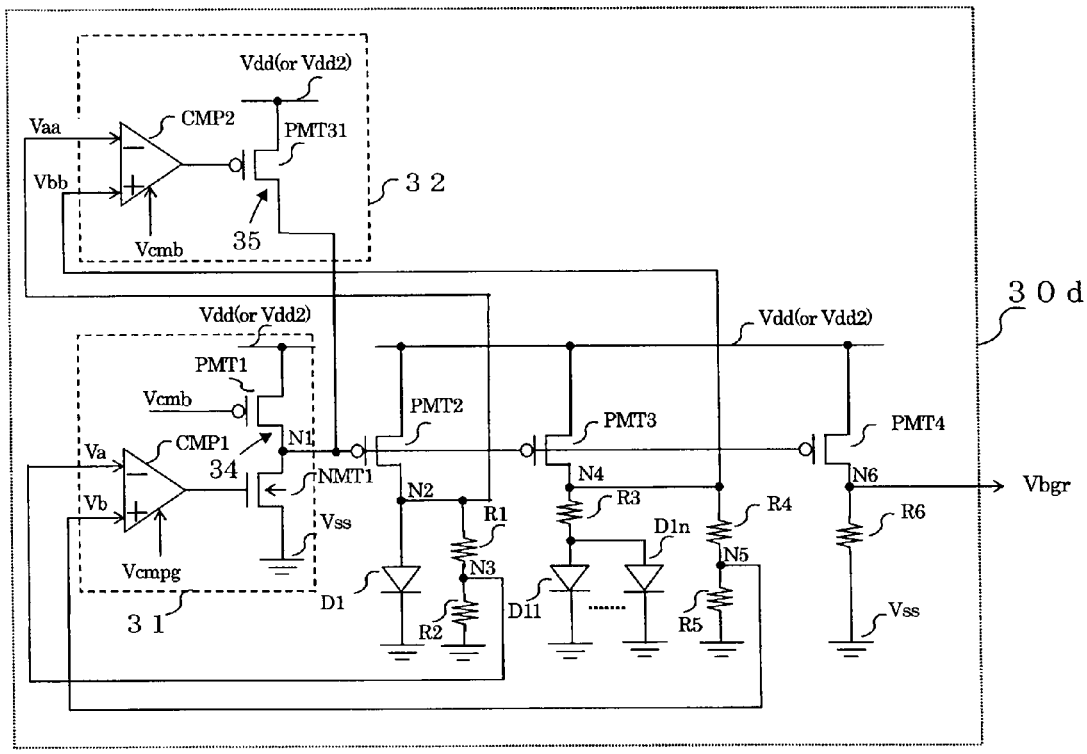
FIG. 10 is a circuit diagram showing a bandgap reference circuit serving as a reference voltage generating circuit according to a fifth embodiment of the present invention.

A reference voltage generating circuit according to a fifth embodiment of the present invention will be described with reference to drawings. FIG. 10 is a circuit diagram showing a bandgap reference circuit serving as the reference voltage generating circuit according to the fifth embodiment of the present invention.

In FIG. 10, the same parts as those in FIG. 7 are given the same reference numerals.

As shown in FIG. 10, a bandgap reference circuit 30*d* is provided with amplifiers 31 and 32, P-channel MOS transistors PMT2 to PMT4, a diode D1, diodes D11 to D1*n*, and resistors R1 to R6. The bandgap reference circuit 30*d* is used as a reference voltage generating circuit for generating the internal power source of a semiconductor memory device, for example.

A feedback voltage Vbb outputted from a node N4 (the drain of the P-channel MOS transistor PMT3) is inputted to the input side plus (+) port of a comparator CMP2 of the amplifier 32. A feedback voltage Vaa outputted from a node N2 (the drain of the P-channel MOS transistor PMT2) is inputted to the input side minus (−) port of the comparator CMP2.

Feedback voltages Va and Vb supplied to a comparator CMP1 and the feedback voltages Vaa and Vbb supplied to the comparator CMP2 are set as follows.

$$Va<Vaa \quad (6)$$

$$Vb<Vbb \quad (7)$$

The amplifier 31 operates in a voltage range where the voltage of a higher voltage power supply Vdd or a higher voltage power supply Vdd2 is not more than a predetermined level. The amplifier 32 operates in a voltage range where the voltage of the higher voltage power supply Vdd or the higher voltage power supply Vdd2 is higher than the predetermined level. The amplifiers 31 and 32 perform a "Rail-to-Rail" operation.

Consequently, a reference voltage Vbgr which is little temperature-dependent and voltage-dependent can be generated over the high and low voltage ranges of the higher voltage power supply Vdd or the higher voltage power supply Vdd2.

Figure 11:
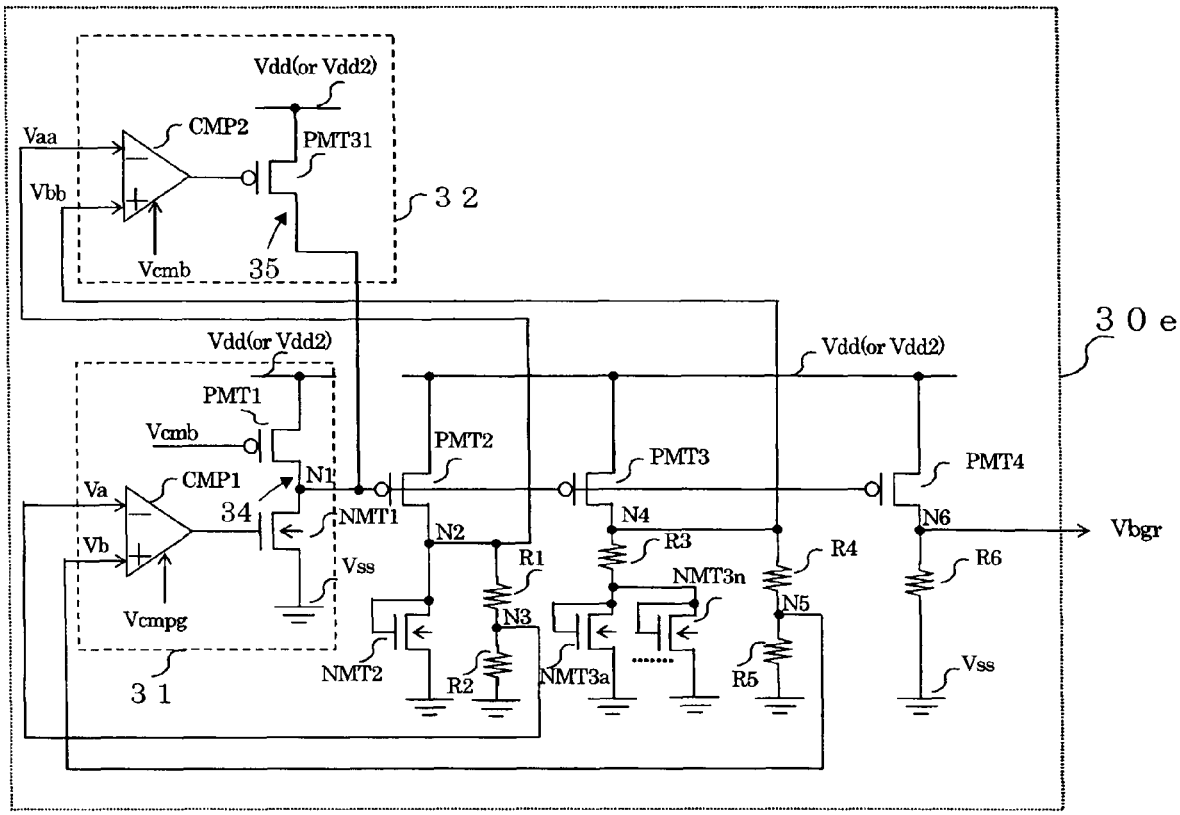
FIG. 11 is a circuit diagram showing a bandgap reference circuit serving as a reference voltage generating circuit according to a sixth embodiment of the present invention.

A reference voltage generating circuit according to a sixth embodiment of the present invention will be described with reference to drawings. FIG. 11 is a circuit diagram showing a bandgap reference circuit serving as the reference voltage generating circuit according to the sixth embodiment of the present invention.

In FIG. 11, the same parts as those in FIG. 10 are given the same reference numerals.

As shown in FIG. 11, a bandgap reference circuit 30*e* is provided with amplifiers 31 and 32, P-channel MOS transistors PMT2 to PMT4, an N-channel MOS transistor NMT2, N-channel MOS transistors NMT3*a* to NMT3*n*, and resistors R1 to R6. The bandgap reference circuit 30*e* is used as a reference voltage generating circuit for generating the internal power source of a semiconductor memory device, for example.

The drain of the N-channel MOS transistor NMT2 is connected to a node N2 and the gate of the N-channel MOS transistor NMT2. The source of the N-channel MOS transistor NMT2 is connected to a lower voltage power supply (grounding potential) Vss. The N-channel MOS transistors NMT3*a* to NMT3*n* connected in parallel with one another are connected between the resistor R3 and the lower voltage power supply (grounding potential) Vss.

Threshold voltages Vth of the N-channel MOS transistor NMT2, and the N-channel MOS transistors NMT3*a* to NMT3*n* are set lower than the forward voltages of the diode D1, and diodes D11 to D1*n* in FIG. 10.

In the bandgap reference circuit 30*e*, the amplifier 31 operates in a voltage range where the voltage of a higher voltage power supply Vdd or a higher voltage power supply Vdd2 is low. The amplifier 32 operates in a voltage range where the higher voltage power supply Vdd or the higher voltage power supply Vdd2 is higher than a predetermined level. Accordingly, the reference voltage generating circuit of the present embodiment performs a Rail-to-Rail operation.

Furthermore, the threshold voltages Vth of the N-channel MOS transistor NMT2 and the N-channel MOS transistors NMT3*a* to NMT3*n* are set at a low level. Thus, a reference voltage Vbgr can be generated in the lower and higher voltage ranges of the higher voltage power supply Vdd or the higher voltage power supply Vdd2 than those of the fifth embodiment in FIG. 10.

In the embodiments described above, the bandgap reference circuit serving as a voltage generating circuit is used as a step-down power source of a semiconductor memory device. Such a voltage generating circuit can be used as the reference voltage generating circuit of an LSI such as SoC (System on Chip) or an analog/digital LSI.

Other embodiments or modifications of the present invention will be apparent to those skilled in the art from consideration of the specification and practice of the invention disclosed herein. It is intended that the specification and example embodiments be considered as exemplary only, with a true scope and spirit of the invention being indicated by the following.

What is claimed is:

1. A reference voltage generating circuit comprising:

a first P-channel insulated-gate field-effect transistor having a gate, a source connected to a higher voltage power supply, and a drain;

a second P-channel insulated-gate field-effect transistor having a gate, a source connected to the higher voltage power supply, and a drain;

a third P-channel insulated-gate field-effect transistor having a gate, a source connected to the higher voltage power supply, and a drain for outputting a reference voltage;

a first diode having a cathode connected to a lower voltage power supply and an anode connected to the drain of the first P-channel insulated-gate field-effect transistor;

first and second resistors connected in series to each other and connected between the drain of the first P-channel insulated-gate field-effect transistor and the lower voltage power supply and;

a third resistor having one end connected to the drain of the second P-channel insulated-gate field-effect transistor;

fourth and fifth resistors connected in series to each other and connected between the drain of the second P-channel insulated-gate field-effect transistor and the lower voltage power supply;

a plurality of second diodes connected in parallel with one another, each of the second diodes having an anode connected to the other end of the third resistor and a cathode connected to the lower voltage power supply;

a first comparator receiving a first feedback voltage obtained from a connection node between the first and second resistors and receiving a second feedback voltage obtained from a connection node between the fourth and fifth resistors;

a first amplifying circuit amplifying an output signal outputted from the first comparator and outputting the amplified signal to the gates of the first, the second and the third P-channel insulated-gate field-effect transistors; and a bias generating circuit having eighth, ninth and tenth P-channel insulated-gate field-effect transistors, a fourth, fifth and sixth N-channel insulated-gate field-effect transistors, a third diode, and a plurality of eighth resistors, wherein a source of the eighth P-channel insulated-gate field-effect transistor is connected to the higher voltage power supply, a gate of the eighth P-channel insulated-gate field-effect transistor is connected to a gate of the ninth P-channel insulated-gate field-effect transistor, a drain of the eighth P-channel insulated-gate field-effect transistor is connected to a drain of the fourth N-channel insulated-gate field-effect transistor, a source of the fourth N-channel insulated-gate field-effect transistor is connected to one end of the third diode, the other end of the third diode is connected to the lower voltage power supply, a source of the ninth P-channel insulated-gate field-effect transistor is connected to the higher voltage power supply, a gate of the ninth P-channel insulated-gate field-effect transistor is connected to a drain of the ninth P-channel insulated-gate field-effect transistor, the drain of the ninth P-channel insulated-gate field-effect transistor is connected to a drain of the fifth N-channel insulated-gate field-effect transistor, a source of the fifth N-channel insulated-gate field-effect transistor is connected to each of one ends of the plurality of eighth resistors, each of the other ends of the plurality of eighth resistors is connected to the lower voltage power supply, a source of the tenth P-channel insulated-gate field-effect transistor is connected to the higher voltage power supply, a gate of the tenth P-channel insulated-gate field-effect transistor is connected to the drain of the ninth P-channel insulated-gate field-effect transistor, a drain of the tenth P-channel insulated-gate field-effect transistor is connected to a drain of the sixth N-channel insulated-gate field-effect transistor, the drain of the sixth N-channel insulated-gate field-effect transistor is connected to a gate of the sixth N-channel insulated-gate field-effect transistor, a source of the sixth N-channel insulated-gate field-effect transistor is connected to the lower voltage power supply, a first control voltage controlling the first comparator is outputted from the drain of the ninth P-channel insulated-gate field-effect transistor, and a second control voltage controlling the first amplifying circuit is outputted from the drain of the tenth P-channel insulated-gate field-effect transistor.

2. A reference voltage generating circuit comprising:

a first P-channel insulated-gate field-effect transistor having a gate, a source connected to a higher voltage power supply, and a drain;

a second P-channel insulated-gate field-effect transistor having a gate, a source connected to the higher voltage power supply, and a drain;

a third P-channel insulated-gate field-effect transistor having a gate, a source connected to the higher voltage power supply, and a drain for outputting a reference voltage;

a first diode having a cathode connected to a lower voltage power supply and an anode connected to the drain of the first P-channel insulated-gate field-effect transistor;

first and second resistors connected in series to each other and connected between the drain of the first P-channel insulated-gate field-effect transistor and the lower voltage power supply and;

a third resistor having one end connected to the drain of the second P-channel insulated-gate field-effect transistor;

fourth and fifth resistors connected in series to each other and connected between the drain of the second P-channel insulated-gate field-effect transistor and the lower voltage power supply;

a plurality of second diodes connected in parallel with one another, each of the second diodes having an anode connected to the other end of the third resistor and a cathode connected to the lower voltage power supply;

a first comparator receiving a first feedback voltage obtained from a connection node between the first and second resistors and receiving a second feedback voltage obtained from a connection node between the fourth and fifth resistors;

a first amplifying circuit amplifying an output signal outputted from the first comparator and outputting the amplified signal to the gates of the first, the second and the third P-channel insulated-gate field-effect transistors; and a second comparator and a second amplifying circuit receiving an output signal from the second comparator, wherein the second comparator receives the first feedback voltage obtained from the connection node between the first and the second resistors and the second feedback voltage obtained from the connection node between the fourth and the fifth resistors, and the second amplifying circuit outputs an output signal to each of the gates of the first, the second and the third P-channel insulated-gate field-effect transistors.

3. The reference voltage generating circuit according to claim 2, wherein the second amplifying circuit includes an eleventh P-channel insulated-gate field-effect transistor, a source of the eleventh P-channel insulated-gate field-effect transistor is connected to the higher voltage power supply, the output signal from the second comparator is inputted to a gate of the eleventh P-channel insulated-gate field-effect transistor, and a drain of the eleventh P-channel insulated-gate field-effect transistor is connected to each of the gates of the first, the second and the third P-channel insulated-gate field-effect transistors.

4. A reference voltage generating circuit comprising:

a first P-channel insulated-gate field-effect transistor having a gate, a source connected to a higher voltage power supply, and a drain, a second P-channel insulated-gate field-effect transistor having a gate, a source connected to the higher voltage power supply, and a drain, a third P-channel insulated-gate field-effect transistor having a gate, a source connected to the higher voltage power supply, and a drain for outputting a reference voltage;

a first diode having a cathode connected to a lower voltage power supply and an anode connected to the drain of the first P-channel insulated-gate field-effect transistor;

first and second resistors connected in series to each other and connected between the drain of the first P-channel insulated-gate field-effect transistor and the lower voltage power supply and;

a third resistor having one end connected to the drain of the second P-channel insulated-gate field-effect transistor;

fourth and fifth resistors connected in series to each other and connected between the drain of the second P-channel insulated-gate field-effect transistor and the lower voltage power supply;

a plurality of second diodes connected in parallel with one another, each of the second diodes having an anode connected to the other end of the third resistor and a cathode connected to the lower voltage power supply;

a first comparator receiving a first feedback voltage obtained from a connection node between the first and second resistors and receiving a second feedback voltage obtained from a connection node between the fourth and fifth resistors;

a first amplifying circuit amplifying an output signal outputted from the first comparator and outputting the amplified signal to the gates of the first, the second and the third P-channel insulated-gate field-effect transistors; and a second comparator and a second amplifying circuit receiving an output signal from the second comparator, wherein the second comparator receives a third feedback voltage obtained from a connection node between the drain of the first P-channel insulated-gate field-effect transistor and the first resistor, and a fourth feedback voltage obtained from a connection node between the drain of the second P-channel insulated-gate field-effect transistor and the third resistor, and the second amplifying circuit outputs an output signal to each of the gates of the first, the second and the third P-channel insulated-gate field-effect transistors.

5. A reference voltage generating circuit comprising:

a first P-channel insulated-gate field-effect transistor having a gate, a source connected to a higher voltage power supply and a drain;

a second P-channel insulated-gate field-effect transistor having a gate, a source connected to the higher voltage power supply and a drain;

a third P-channel insulated-gate field-effect transistor having a gate, a source connected to the higher voltage power supply and a drain for outputting a reference voltage;

a first diode-connected N-channel insulated-gate field-effect transistor having one end connected to a lower voltage power supply and the other end connected to the drain of the first P-channel insulated-gate field-effect transistor;

first and second resistors connected in series to each other and connected between the drain of the first P-channel insulated-gate field-effect transistor and the lower voltage power supply;

a third resistor having one end connected to the drain of the second P-channel insulated-gate field-effect transistor;

fourth and fifth resistors connected in series to each other and connected between the drain of the second P-channel insulated-gate field-effect transistor and the lower voltage power supply;

a plurality of second diode-connected N-channel insulated-gate field-effect transistors connected in parallel with one another, each of the second diode-connected N-channel insulated-gate field-effect transistors having one end connected to the other end of the third resistor and the other end connected to the lower voltage power supply;

a first comparator receiving a first feedback voltage obtained from a connection node between the first and second resistors and a second feedback voltage obtained from a connection node between the fourth and fifth resistors;

a first amplifying circuit amplifying an output signal outputted from the first comparator, the first amplifying circuit outputting the amplified signal to the gates of the first, the second and the third P-channel insulated-gate field-effect transistor; and a bias generating circuit having eighth, ninth and tenth P-channel insulated-gate field-effect transistors, a fourth, fifth and sixth N-channel insulated-gate field-effect transistors, a third diode-connected N-channel insulated-gate field-effect transistor, and a plurality of eighth resistors, wherein a source of the eighth P-channel insulated-gate field-effect transistor is connected to the higher voltage power supply, a gate of the eighth P-channel insulated-gate field-effect transistor is connected to a gate of the ninth P-channel insulated-gate field-effect transistor, a drain of the eighth P-channel insulated-gate field-effect transistor is connected to a drain of the fourth N-channel insulated-gate field-effect transistor, a source of the fourth N-channel insulated-gate field-effect transistor is connected to one end of the third diode-connected N-channel insulated-gate field-effect transistor, the other end of the third diode-connected N-channel insulated-gate field-effect transistor is connected to the lower voltage power supply, a source of the ninth P-channel insulated-gate field-effect transistor is connected to the higher voltage power supply, a gate of the ninth P-channel insulated-gate field-effect transistor is connected to a drain of the ninth P-channel insulated-gate field-effect transistor, the drain of the ninth P-channel insulated-gate field-effect transistor is connected to a drain of the fifth N-channel insulated-gate field-effect transistor, a source of the fifth N-channel insulated-gate field-effect transistor is connected to each of one ends of the plurality of eighth resistors, each of the other ends of the plurality of eighth resistors is connected to the lower voltage power supply, a source of the tenth P-channel insulated-gate field-effect transistor is connected to the higher voltage power supply, a gate of the tenth P-channel insulated-gate field-effect transistor is connected to the drain of the ninth P-channel insulated-gate field-effect transistor, a drain of the tenth P-channel insulated-gate field-effect transistor is connected to a drain of the sixth N-channel insulated-gate field-effect transistor, the drain of the sixth N-channel insulated-gate field-effect transistor is connected to a gate of the sixth N-channel insulated-gate field-effect transistor, a source of the sixth N-channel insulated-gate field-effect transistor is connected to the lower voltage power supply, a first control voltage controlling the first comparator is outputted from the drain of the ninth P-channel insulated-gate field-effect transistor, and a second control voltage controlling the first amplifying circuit is outputted from the drain of the tenth P-channel insulated-gate field-effect transistor.

6. A reference voltage generating circuit comprising:

a first P-channel insulated-gate field-effect transistor having a gate, a source connected to a higher voltage power supply and a drain;

a second P-channel insulated-gate field-effect transistor having a gate, a source connected to the higher voltage power supply and a drain;

a third P-channel insulated-gate field-effect transistor having a gate, a source connected to the higher voltage power supply and a drain for outputting a reference voltage;

a first diode-connected N-channel insulated-gate field-effect transistor having one end connected to a lower voltage power supply and the other end connected to the drain of the first P-channel insulated-gate field-effect transistor;

first and second resistors connected in series to each other and connected between the drain of the first P-channel insulated-gate field-effect transistor and the lower voltage power supply;

a third resistor having one end connected to the drain of the second P-channel insulated-gate field-effect transistor;

fourth and fifth resistors connected in series to each other and connected between the drain of the second P-channel insulated-gate field-effect transistor and the lower voltage power supply;

a plurality of second diode-connected N-channel insulated-gate field-effect transistors connected in parallel with one another, each of the second diode-connected N-channel insulated-gate field-effect transistors having one end connected to the other end of the third resistor and the other end connected to the lower voltage power supply;

a first comparator receiving a first feedback voltage obtained from a connection node between the first and second resistors and a second feedback voltage obtained from a connection node between the fourth and fifth resistors;

a first amplifying circuit amplifying an output signal outputted from the first comparator, the first amplifying circuit outputting the amplified signal to the gates of the first, the second and the third P-channel insulated-gate field-effect transistor; and a second comparator and a second amplifying circuit receiving an output signal from the second comparator, wherein the second comparator receives the first feedback voltage obtained from the connection node between the first and second resistors, and the second feedback voltage obtained from the connection node between the fourth and fifth resistors, and the second amplifying circuit outputs an output signal to each of the gates of the first, second and third P-channel insulated-gate field-effect transistors.

7. The reference voltage generating circuit according to claim 6, wherein the second amplifying circuit includes an eleventh P-channel insulated-gate field-effect transistor, a source of the eleventh P-channel insulated-gate field-effect transistor is connected to the higher voltage power supply, the output signal from the second comparator is inputted to a gate of the eleventh P-channel insulated-gate field-effect transistor, and a drain of the eleventh P-channel insulated-gate field-effect transistor is connected to each of the gates of the first, the second and the third P-channel insulated-gate field-effect transistors.

* * * * *